US006637939B2

(12) United States Patent
Huffer

(10) Patent No.: US 6,637,939 B2
(45) Date of Patent: Oct. 28, 2003

(54) VENTED BAG FOR MICROWAVE COOKING

(75) Inventor: Scott Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/071,584

(22) Filed: Feb. 8, 2002

(65) Prior Publication Data

US 2003/0152296 A1 Aug. 14, 2003

(51) Int. Cl.[7] ..... B65D 33/01
(52) U.S. Cl. ..... 383/64; 383/100; 426/118
(58) Field of Search ..... 383/63, 64, 100, 383/101; 426/107, 113, 118

(56) References Cited

U.S. PATENT DOCUMENTS

| | | | | | |
|---|---|---|---|---|---|
| 2,633,284 | A | * | 3/1953 | Moffett et al. | 220/202 |
| 3,672,915 | A | * | 6/1972 | Wiggins | 426/118 |
| 4,404,241 | A | * | 9/1983 | Mueller et al. | 383/103 |
| 5,059,036 | A | | 10/1991 | Richison et al. | 383/61 |
| 5,067,208 | A | | 11/1991 | Herrington, Jr. et al. | 24/400 |
| 5,240,112 | A | | 8/1993 | Newburger | 206/524.8 |
| 5,261,532 | A | * | 11/1993 | Fauci | 206/218 |
| 5,450,963 | A | | 9/1995 | Carson | 206/524.8 |
| 5,480,030 | A | | 1/1996 | Sweeney et al. | 206/524.8 |
| 5,511,884 | A | * | 4/1996 | Bruno et al. | 383/63 |
| 5,540,500 | A | * | 7/1996 | Tanaka | 383/43 |
| 5,544,752 | A | | 8/1996 | Cox | 206/524.8 |
| 5,881,881 | A | | 3/1999 | Carrington | 206/524.8 |
| 5,911,508 | A | | 6/1999 | Dobreski et al. | 383/5 |
| 5,934,806 | A | * | 8/1999 | Tomic et al. | 383/63 |
| 5,947,603 | A | * | 9/1999 | Tilman | 383/64 |
| 5,996,800 | A | | 12/1999 | Pratt | 206/524.8 |
| 6,010,244 | A | | 1/2000 | Dobreski et al. | 383/63 |
| 6,036,364 | A | * | 3/2000 | Heuvel | 383/64 |
| 6,045,264 | A | * | 4/2000 | Miniea | 383/41 |
| 6,056,119 | A | | 5/2000 | Risgalla et al. | 206/522 |
| 6,059,457 | A | | 5/2000 | Sprehe et al. | 383/63 |
| 6,085,906 | A | | 7/2000 | Lambert | 206/524.8 |
| 6,089,271 | A | | 7/2000 | Tani | 137/854 |
| 6,120,817 | A | | 9/2000 | Archibald et al. | 426/106 |
| 6,202,849 | B1 | | 3/2001 | Graham | 206/524.8 |
| 6,231,236 | B1 | | 5/2001 | Tilman | 383/63 |
| 6,299,353 | B1 | * | 10/2001 | Piechocki et al. | 383/63 |

FOREIGN PATENT DOCUMENTS

| | | |
|---|---|---|
| DE | 595874 | 4/1934 |
| JP | 3-212355 | 9/1991 |
| NL | 107100 | 1/1964 |

* cited by examiner

*Primary Examiner*—Lee Young
*Assistant Examiner*—Joseph C. Merek
(74) *Attorney, Agent, or Firm*—Drinker Biddle & Reath LLP

(57) ABSTRACT

A microwave cooking container includes a bag portion having an open end for access to an interior of the bag and a closure mechanism for sealing the open end having elongated interfitting elements extending adjacent the open end of the bag. The container also includes a valve assembly providing controlled discharge of pressurized fluid from the bag interior when a positive pressure equal to or exceeding a predetermined pressure is created within the bag interior. The valve assembly includes a vent member and a flow limiter. The vent member is located at the open end of the bag adjacent an end of the closure mechanism such that the first end of the internal passage is in fluid communication with the bag interior. The internal passage provides an exit path for discharge of a pressurized fluid from the interior of the bag. The flow limiter may include an end portion of a closure clamp adapted to receive the vent member.

11 Claims, 3 Drawing Sheets

FIG.1
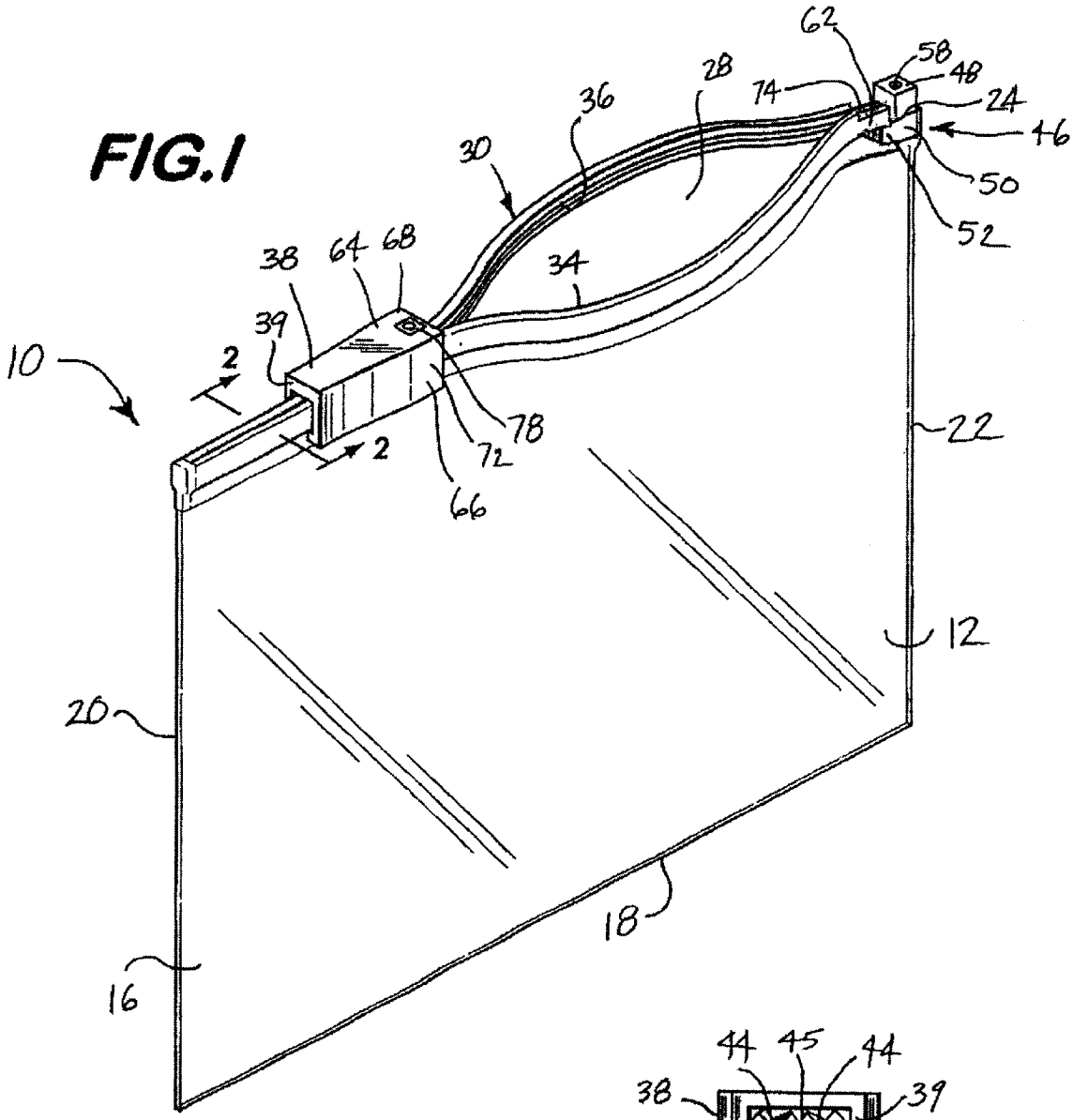
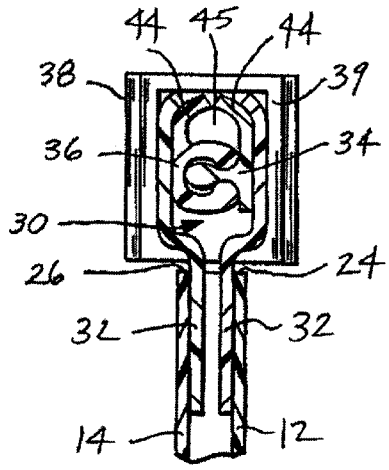
FIG.2

FIG.3
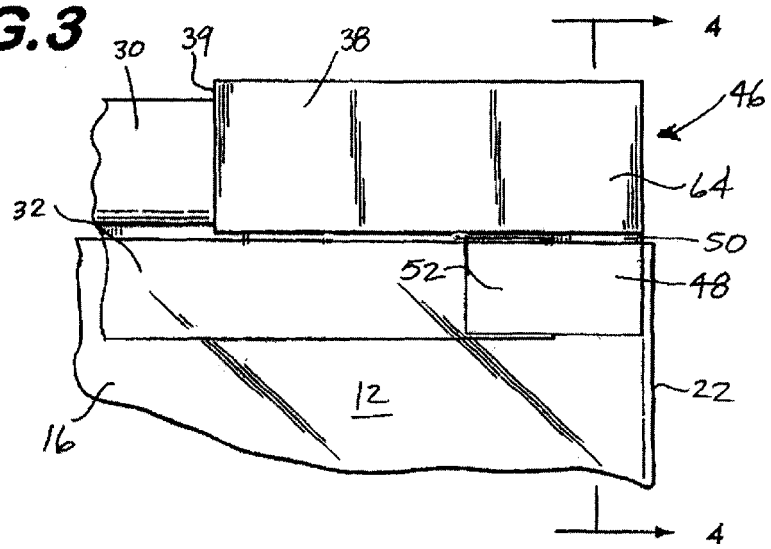
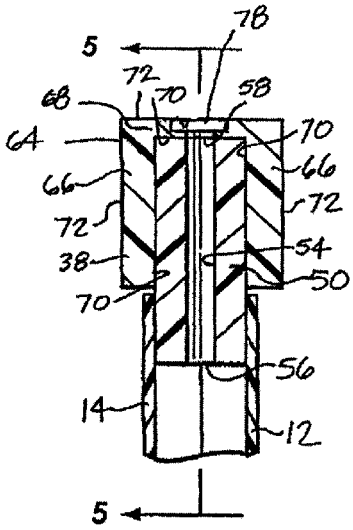
FIG.4
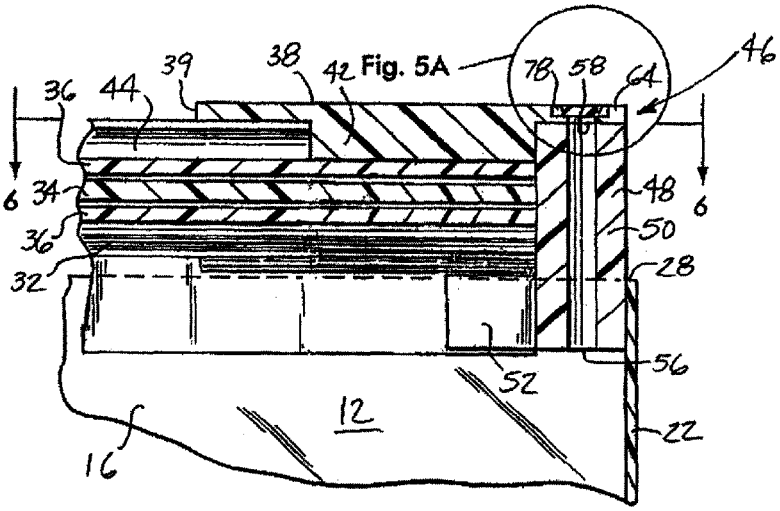
FIG.5
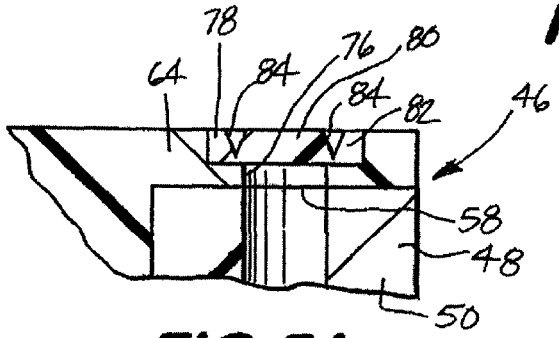
FIG.5A

FIG. 6
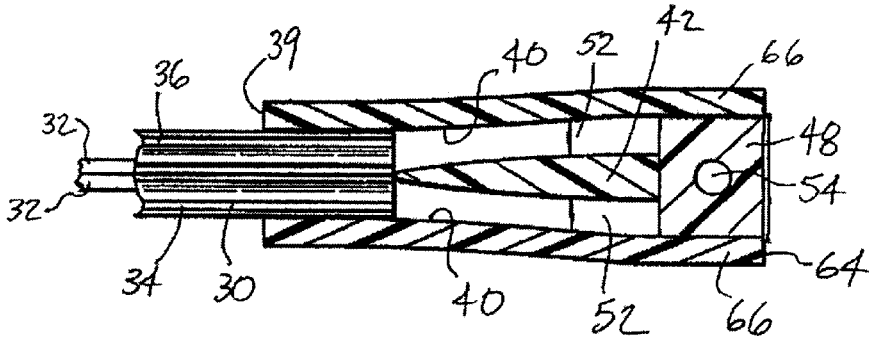
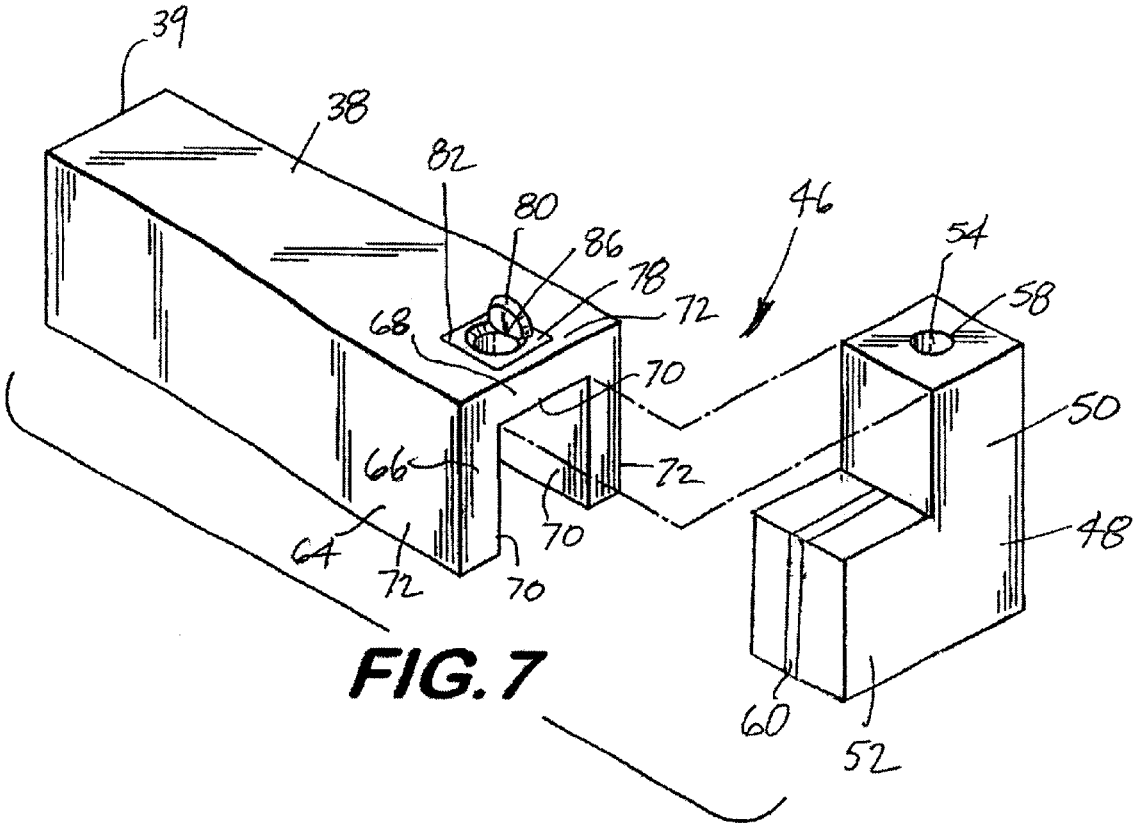
FIG. 7

VENTED BAG FOR MICROWAVE COOKING

FIELD OF THE INVENTION

The present invention relates to a flexible container, such as a resealable storage bag for food products and the like. More particularly, the present invention relates to a resealable bag that is vented for microwave cooking of sealed food products.

BACKGROUND OF THE INVENTION

Flexible containers, such as plastic bags, for containment or storage of food products and the like are well known. Prior art storage bags include closure mechanisms having interconnecting elements extending along the open end of the bag to provide a resealable access to the interior of the bag. The elements of the closure mechanism are engageable with each other in response to a sliding compression. These closure mechanisms are commonly known as zipper closures. Prior art storage bags include clamping elements that are slidably received by the zipper closure to facilitate opening and closing of the sealable access.

The closure mechanisms of prior art bags provide for sealed enclosure of various products including food products having a liquid component. Consumers commonly use the storage bags for storage of food product in a refrigerator or freezer for later use. The food product being stored in the refrigerator or freezer will frequently be of a type suitable for heating in a microwave oven. However, prior art storage bags do not provide for microwaving of food products in the sealed condition. The sealed enclosure provided by prior art storage bags is subjected to internal pressure during microwave cooking of many food products. The pressure results from expansion associated with a change of a liquid component of the sealed contents into a vapor state during the microwave heating of the bag contents. Prior art storage bags subjected to positive internal pressure from expansion of the liquid into vapor may burst. Alternatively, the positive pressure may force the elements of the zipper closure to disengage from each other leading to spillage of the food product.

Plastic storage bags of the prior art include bags adapted for storage of compressible articles such as clothing. These storage bags include a zipper closure mechanism to provide a resealable access to the interior of the bag. The storage bags also include a one-way valve for removal of air from the bag after the compressible article has been sealed within the interior of the bag. The one-way valve allows for passage of air from the interior of the bag to an exterior location in response to vacuum applied to the bag interior. The one-way valve functions to prevent passage of air in the reverse direction into the interior of the bag. The one-way valve is positioned on one of the panels of the bag to facilitate attachment of a source of vacuum to the valve for removal of air from the sealed interior.

The one-way valves of the prior art storage bags for compressible articles are not suitable for use in venting of a food storage bag. The one way valve will allow for passage of fluid from the bag interior in response to a positive pressure applied to the bag interior as well as the intended application of vacuum from an exterior location through the valve. Therefore, positive pressure applied to the bag contents, by handling and storage of the bag, for example, will result in contained fluids being directed through the valve to the bag exterior. Food storage bags are intended for storage of all manner of food product including food product having a relatively large percentage of liquids. Therefore, undesirable discharge of the liquid through the one-way valve during handling and storage of the bag could result were a storage bag for compressible articles be used to store food products.

SUMMARY OF THE INVENTION

According to the present invention, there is provided a microwavable cooking container. The container includes a pair of flexible panels secured together to form a bag having an open end for access to an interior of the bag. The container further includes a closure mechanism for sealing the open end of the bag having elongated interfitting elements extending adjacent the open end of the bag.

The container also includes a valve assembly including a vent member. The vent member includes an internal passage having first and second ends. The vent member is located at the open end of the bag adjacent an end of the closure mechanism such that the first end of the internal passage is in fluid communication with the bag interior. The internal passage provides an exit path for discharge of a pressurized fluid from the interior of the bag. The container further includes a flow limiter operably engaging the vent member adjacent the second end of the internal passage. The flow limiter prevents discharge of fluid from the internal passage in the absence of a predetermined positive pressure in the bag interior. The flow limiter is adapted to permit discharge when a positive pressure equal to or exceeding the predetermined pressure is created within the bag interior.

According to one embodiment of the invention the container includes a closure clamp slidably received by the closure mechanism for opening and closing the access to the bag interior. The flow limiter includes an end portion of the closure clamp adapted to receive at least a part of the vent member adjacent the second end of the internal passage. The end portion of the closure clamp further includes an opening that is substantially aligned with the second end of the internal passage when the vent member is received by the end portion. The flow limiter further includes a burstable seal that extends across the opening to limit discharge of fluid from the internal passage of the vent member. The burstable seal is adapted to burst when a pressure equal to or exceeding the predetermined pressure is created within the bag interior.

According to one embodiment of the present invention, the burstable seal includes a weakened portion comprising a reduced thickness portion of the burstable seal that defines a burst region.

BRIEF DESCRIPTION OF THE DRAWINGS

For the purpose of illustrating the invention, there is shown in the drawings that is presently preferred; it being understood, however, that this invention is ted to the precise arrangements and instrumentalities shown.

FIG. 1 is a perspective view of a vented cooking container according to the present invention;

FIG. 2 is a sectional view taken along line 2—2 of FIG. 1;

FIG. 3 is a partial side view of the cooking container of FIG. 1;

FIG. 4 is a sectional view taken along line 4—4 of FIG. 3;

FIG. 5 is a partial sectional view taken along the line 5—5 of FIG. 4;

FIG. 5A is an enlarged detail view of a portion of the container of FIG. 5;

FIG. 6 is a sectional view taken along the line 6—6 of FIG. 5; and

FIG. 7 is a schematic perspective view illustrating the vent member and losure clamp of the container of FIG. 1.

DETAILED DESCRIPTION OF THE DRAWINGS

Referring to the drawings where like numerals refer to like elements, there in FIGS. 1–5 a microwavable cooking container 10 according to the present As seen in FIG. 1, the container of includes first and second rectangular panels 12, 14 secured together to form a bag 16 having an interior defined between the panels 12, 14. The panels are secured along a bottom end 18 of the bag and along sides 20, 22 of the bag. The panels 12, 14 have upper edges 24, 26 defining an open upper end 28 of the bag for access to the bag interior.

The material from which the panels 12, 14 are made needs to provide for sufficient flexibility for the bag 16. The material selected for the panels must also be capable of withstanding the conditions imposed on the bag by microwave cooking of a contained substance. Suitable materials possessing the required properties include cast polypropylene and nylon. The invention, however, is not limited to these preferred materials.

The bag 16 is most preferably formed from a single sheet of flexible material folded upon itself at bottom end 18 to form the opposite panels 12, 14. The edges of the folded sheet that extend from the bottom end 18 are then bonded to one another. The panels 12, 14, however, could also comprise separate sheets bonded along three sides to form the bag 16.

The cooking container 10 includes a closure mechanism 30 secured to the upper end 28 of bag 16 for opening and closing the upper end. The closure mechanism 30 includes elongated strips 32 bonded to the edges 24, 26 of panels 12, 14. The strips 32 are preferably cast polypropylene or nylon. Each of the strips 32 carries one of two closure elements 34, 36 secured to the strip to extend along its length. The closure elements 34, 36 are, respectively, male and female elements that interconnect with each other to provide a sealed closure. The closure elements 34, 36 of the closure mechanism are adapted to engage each other when they are subjected to a sliding compression. Closure mechanisms for sealing storage bags are known in the art and are commonly referred to as "zipper" closures.

The cooking container 10 also includes a closure clamp 38 adapted for receipt by the closure mechanism 30 to provide compression of the closure mechanism for engagement of the closure elements 34, 36. The closure clamp 38 is preferably made from a plastic material. The closure clamp 38 is slidably supported by the closure mechanism 30 for translation of the closure clamp with respect to the closure elements 34, 36. As shown in FIG. 6, the closure clamp 38 includes internal surfaces 40 that converge towards one another at a minimum of separation at a forward end 39 of clamp 38. The minimum separation at the forward end 39 should be narrow enough to ensure engagement between the closure elements 34, 36 but should not be so narrow as to inhibit sliding of the closure clamp 38 with respect to the closure mechanism 30. The closure clamp 38 also includes an internal wedge 42 supported to extend between the closure elements 34, 36. The wedge 42 functions to disengage the closure elements 34, 36 from one another when the wedge 42 is directed between them. The construction of the closure clamp 38, therefore, serves to alternatively engage or disengage the closure elements 34, 36 to close or open the upper end 28 of bag 16. With respect to the view shown in FIG. 1, the clamp 38 will close the bag 16 when the clamp 38 is directed to the right and will open the bag 16 when directed to the left. Closure clamps for zipper closures having converging surfaces and wedges are known.

Referring to FIG. 5, the wedge 42 is located in an upper portion of the closure clamp 38 and does not extend throughout the height of the clamp 38. As seen in FIG. 2, each of the closure elements 34, 36 includes a tab 44 extending from an upper end of the closure elements. The tabs 44 define a space 45 above the interconnecting portions of the closure elements 34, 36 when the closure mechanism 30 is in the sealed condition shown in FIG. 2. The wedge 42 is adapted for receipt by the closure mechanism 30 such that the wedge 42 penetrates the space 45 above the connecting portions of the closure elements 34, 36 as the closure clamp is directed to the left in the perspective view shown in FIG. 1. Separation of the tab portions 44 by the wedge 42, in turn, causes separation of the connecting portions of the closure elements 34, 36 and opening of the upper end 28 of bag 16.

The container 10 of the present invention includes a valve assembly 46 providing a controlled discharge of pressurized fluid from the interior of the bag 16. As will be described in greater detail, the valve assembly 46 functions to prevent discharge of the fluid from the interior of bag 16 in the absence of a predetermined positive pressure in the bag interior. Preventing fluid discharge at lower pressures limits undesirable discharge of fluid that might otherwise result merely from handling or storage of a container 10, for example. Limiting passage of fluid through the valve assembly 46 at lower pressures also facilitates sealing of the bag 16, one of the principal intended functions for bags having zippered closures.

As will be described below, the valve assembly 46 also functions to permit fluid discharge from the interior of bag 16 to an exterior location when a pressure equal to or greater than the predetermined pressure is applied to the bag interior. The predetermined pressure at which the valve assembly 46 will permit fluid discharge should be less than the pressure which would cause separation of the interconnecting closure elements 34, 36. Such unintended separation of the closure elements 34, 36 could result in spillage of the contents of the bag 16 within a microwave depending on the particular contents being microwaved.

The valve assembly 46 includes a vent member 48 located at the upper end 28 of bag 16 adjacent side 22. The vent member 48 includes a fluid discharge portion 50 and a closure attachment portion 52. The fluid discharge portion 50 includes an internal passage 54 extending through the fluid discharge portion between a first end 56 and an opposite second end 58. The vent member 48 is located at the upper end 28 of the bag 16 adjacent side 22 of the bag such that the first end 56 of the internal passage 54 is in fluid communication with the interior of bag 16. As shown in FIG. 7, the closure attachment portion 52 includes a narrow discontinuity 60 extending through the middle of the closure attachment portion. An end 62 of the closure mechanism 30 is received in the discontinuity 60 of the closure attachment portion 52 of the vent member 48. The upper end 28 of the bag 16 is secured to opposite sides of the closure attachment portion 52 and to a lower part of the fluid discharge portion 50 to seal the bag 16 to the vent member 48. As shown in FIG. 1, an upper part of the fluid discharge portion 50 extends from the bag 16 such that the second end 58 of the passage 54 is in fluid communication with an exterior location with respect to the bag 16.

The internal passage 54 of the venting member 48 provides an exit flow path for discharge of a pressurized fluid from the interior of the bag 16 to an exterior location. Such pressurization could result, for example, when a liquid portion of a contained food product is converted to a vapor state during microwave cooking of the food product. The change in phase results in expansion of the formerly liquid portion of the food product that may lead to pressurization of the vapor within the interior of the sealed bag 16. The vent member 48 of valve assembly 46 therefore prevents bursting of the bag 16 by providing for venting of pressurized fluid from the bag interior.

Referring to FIG. 4, a rearward end portion 64 of the closure clamp 38 includes side walls 66 and a top wall 68 that collectively define a channel. The walls 66, 68 include inner surfaces 70 and opposite outer surfaces 72. The rearward end portion 64 is adapted to receive the upper part of the fluid discharge portion 50 of the vent member 48 with the second end 58 of the internal passage 54 adjacent the top wall 68. The second end 58 of the internal passage 54 is thereby enclosed within the channel defined by the rearward end portion 64. The rearward end portion 64 and the fluid discharge portion 50 are dimensioned to provide for a close interfit therebetween such that discharge of fluid through the internal passage 52 may be controlled in the manner to be described.

A portion of the tabs 44 of the closure mechanism 30 is removed to define a notch 74 adjacent end 62 of the closure mechanism. The notch 74 extends to the top of the connecting portions of the closure elements 34, 36 to accommodate the wedge 42 allowing the rearward end portion 64 of the closure clamp 38 to engage vent member 48.

Referring to FIGS. 4, 5 and 5A, the closure clamp 38 includes an opening 76 in the rearward end portion 64 extending from the inner surface 70 of the top wall 68. The opening 76 is positioned on the rearward end portion 64 of the closure clamp 38 such that the opening 62 will be substantially aligned with the second end 58 of the internal passage 54 of vent member 48 when the closure clamp 38 engages the fluid discharge portion 50.

The closure clamp 38 includes a burstable seal 78 secured to the rearward end portion 64. The burstable seal 78 is located adjacent the outer surface 72 of the top wall 68 to extend across the opening 76. The burstable seal 78 is preferably adhered to the top wall 68 about its outer periphery. Alternatively, the burstable seal 78 could also comprise an integral portion of the closure clamp 38. The burstable seal 78 functions as a flow limiter to prevent discharge of fluid from the internal passage 52 in the absence of the predetermined positive pressure in the interior of bag 16.

The burstable seal 78 is adapted to burst when a pressure equal to or exceeding the predetermined positive pressure is applied to the interior of bag 16. As shown in FIG. 7, the burstable seal 78 includes a circular burst region 80 surrounded by a support portion 82. The burst region 80 is defined by a weakened portion 84 of the burstable seal 78 extending along the outer periphery of the burst region. The burst region 80 is positioned with respect to the seal 78 such that the burst region 80 communicates with the opening 76 in the top wall 68. The burst region 80 will therefore be subjected to pressure from fluid that has been directed into the opening 76 from the aligned internal passage 54 of the vent member 48. The weakened portion 84 of burstable seal 78 has a thickness that is reduced with respect to adjacent portions of the burstable seal. The weakened portion 84 extends around a majority of the burst. region 80. Preferably, as shown, the weakened portion 84 does not extend around the entire periphery of the burst region 80. The weakened portion 84 has discontinuous ends. A portion of the burstable seal 78 located between the ends of the weakened portion 84 defines a holder 86. The holder 86 functions to maintain attachment between the burst region 80 and the support portion 82 of the burstable seal 78 when the weakened portion 84 bursts and the burst region 80 deflects with respect to the support portion 82.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather should be construed in breadth and scope in accordance with the recitation of the appended claims.

What is claimed is:

1. A flexible container comprising:

a pair of flexible panels secured together to form a bag having an open end for access to an interior of the bag, the bag having a first side and an opposite second side;

a closure mechanism having elongated interfitting elements each secured to one of the bag panels adjacent the open end of the bag, the closure mechanism extending along the open end of the bag for sealing the open end;

a vent member defining an internal passage, the internal passage having first and second ends, the vent member located at the open end of the bag adjacent an end of the closure mechanism such that the first end of the internal passage is in fluid communication with the bag interior, the internal passage providing an exit path for discharge of a pressurized fluid from the bag interior, the vent member located adjacent the first side of the bag;

a closure clamp slidingly received by the closure elements for translation of the clamp with respect to the bag between an open bag position in which the clamp is located adjacent the second end of the bag and a closed bag position in which the clamp is located adjacent the first end of the bag; and a flow limiter comprising an end portion of the closure clamp, the end portion of the closure clamp defining a channel adapted for engagement with a portion of the vent member, the flow limiter operably engaging the vent member adjacent the second end of the internal passage such that discharge of the fluid from the internal passage will be prevented in the absence of a predetermined positive pressure in the bag interior, the flow limiter adapted to permit discharge when a positive pressure equal to or exceeding the predetermined pressure is created within the bag interior.

2. The container according to claim 1, wherein the end portion of the closure clamp includes wall portions defining the channel having, the wall portions having opposite inner and outer surfaces, and wherein the flow limiter further comprises an opening in one of the walls of the end portion extending between the inner and outer surfaces, the opening in the wall of the end portion positioned for substantial alignment with the second end of the internal passage of the vent member when the closure clamp engages the vent member in the closed position, and wherein the flow limiter further comprises a seal attached to the closure clamp to extend across the opening in the wall of the end portion.

3. The container according to claim 2, wherein the seal is located adjacent the outer surface of the end portion opening.

4. The container according to claim 2, wherein the seal comprises at least one portion having a thickness that is reduced with respect to adjacent portions of the seal, the reduced thickness portion defining a burst region of the seal surrounded by a support portion, the reduced thickness portion adapted to burst when a positive pressure equal to or exceeding the predetermined value is applied to fluid in the bag interior such that at least a portion of the burst region will be separated from the support portion to permit exit of fluid from the bag interior.

5. The container according to claim 4, wherein the burst region of the seal is substantially circular and wherein the reduced thickness portion extends around a majority of the burst region between opposite ends for deflection of at least a portion of the burst region with respect to the support portion when a positive pressure equal to or exceeding the predetermined value is applied to fluid in the bag interior, the seal comprising a burst region holder that extends between the opposite ends of the reduced thickness portion for maintaining attachment between the burst region and the support portion during deflection of the burst region.

6. A storage container for food products and the like comprising:

first and second flexible panels secured together to form a bag having an interior, a first edge of the panels defining an access to the bag interior;

a closure mechanism for sealing the bag access having opposite ends, the closure mechanism having releasably interconnecting male and female elements secured to the first and second panels, respectively, adjacent the first edge; and a valve defining an exit path extending from the bag interior to an exterior location, the valve providing for a controlled flow of a pressurized fluid in the exit path, the valve comprising a vent member located between the first and second panels adjacent their first edges, the vent member having a first portion defining an internal passage and a second portion adapted to receive one of the ends of the closure mechanism, the internal passage forming at least a portion of the exit flow path and having a first end in fluid communication with the bag interior and an opposite second end, a flow limiter engaging the vent member and including a burstable seal supported to extend across the exit path to prevent flow in the absence of a predetermined positive pressure within the bag interior, the burstable seal adapted to burst when a positive pressure equal to or greater than the predetermined pressure is created within the bag interior.

7. The storage container according to claim 6, further comprising a bag closure clamp for sealing and unsealing the bag access, the bag closure clamp slidably received by the male and female elements of the closure mechanism, and wherein the flow limiter comprises an end portion of the closure clamp defining a channel adapted to receive the vent member adjacent the second end of the internal passage, and wherein the burstable seal is supported by the vent, recieving end portion of the closure clamp such that the seal will be substantially aligned with the second end of the internal passage when the vent member is received by the channel of the closure clamp.

8. The storage container according to claim 7, wherein the vent recieving end portion of the closure clamp comprises a plurality of walls defining the channel, each of the walls having an inside surface and an opposite outside surface, one of the walls including an opening that extends between the inside surface and the outside surface, the opening positioned such that the opening in the wall will be substantially aligned with the second end of the internal passage when the vent member is received by the channel of the closure clamp, and wherein the burstable seal is secured to the wall to extend across the opening.

9. The storage container according to claim 8, wherein the burstable seal is secured to the opening adjacent the outside surface of the wall of the closure clamp.

10. The storage container according to claim 6, wherein the burstable seal comprises at least one portion having a thickness that is reduced with respect to adjacent portions of the seal, the reduced thickness portion defining a burst region of the seal surrounded by a support portion, the reduced thickness portion adapted to burst when a positive pressure equal to or exceeding the predetermined value is applied to fluid in the bag interior such that at least a portion of the burst region will be separated from the support portion to permit passage of fluid from the exit path to the exterior location.

11. A storage bag for microwave cooking of food products and the like comprising:

a bag portion having an interior and an open end defining an access to the interior;

a closure mechanism for sealing the access to the interior, the closure mechanism having interconnecting male and female elements secured to the bag portion adjacent the open end;

a vent member located at the open end of the bag, the vent member including an internal passage having a first end in fluid communication with the bag interior and an opposite second end for discharge of a pressurized fluid from the bag interior; and a closure clamp slidably received by the closure mechanism for opening and closing the access, the closure clamp having an end portion engageable with at least a portion of the vent member adjacent the second end of the passage, the engagement between the closure clamp and the vent member preventing discharge of fluid from the internal passage of the vent in the absence of a predetermined pressure in the bag interior, the end portion of the closure clamp adapted to permit discharge when a pressure equal to or exceeding the predetermined pressure is created within the bag interior.

* * * * *